US012227272B2

(12) United States Patent
Venables et al.

(10) Patent No.: US 12,227,272 B2
(45) Date of Patent: Feb. 18, 2025

(54) FIN STABILIZER WITH INTERNAL ACTUATION MECHANISM

(71) Applicant: Naiad Maritime Group, Inc., Shelton, CT (US)

(72) Inventors: John D. Venables, Monroe, CT (US); Steven J. Venables, Monroe, CT (US); Ryan W. Knapp, Sandy Hook, CT (US)

( * ) Notice: Subject to any disclaimer, the term of this patent is extended or adjusted under 35 U.S.C. 154(b) by 463 days.

(21) Appl. No.: 17/585,905

(22) Filed: Jan. 27, 2022

(65) Prior Publication Data

US 2022/0234699 A1 Jul. 28, 2022

Related U.S. Application Data

(60) Provisional application No. 63/142,275, filed on Jan. 27, 2021.

(51) Int. Cl.
*B63B 39/06* (2006.01)

(52) U.S. Cl.
CPC ..... *B63B 39/06* (2013.01); *B63B 2039/067* (2013.01); *B63B 2039/068* (2013.01)

(58) Field of Classification Search
CPC ..... B63B 39/06; B63B 2039/067; B63B 2039/068
See application file for complete search history.

(56) References Cited

U.S. PATENT DOCUMENTS

| | | | | |
|---|---|---|---|---|
| 3,924,555 A | | 12/1975 | Napolitano | |
| 3,972,301 A | | 8/1976 | Protta | |
| 3,990,385 A | | 11/1976 | Adams | |
| 4,342,275 A | * | 8/1982 | Brix | B63H 25/12 244/87 |
| 4,434,738 A | | 3/1984 | Barkemeyer | |

FOREIGN PATENT DOCUMENTS

| | | | |
|---|---|---|---|
| CN | 110356525 | A | 10/2019 |
| KR | 20110019842 | A | 3/2011 |
| KR | 20150056977 | A | 5/2015 |
| NO | 125620 | B | 10/1972 |
| WO | 2019021094 | A1 | 1/2019 |
| WO | 2021140409 | A1 | 7/2021 |

OTHER PUBLICATIONS

International Search Report and Written Opinion of the Searching Authority in corresponding International Application PCT/US2022/014067 dated May 6, 2022.

* cited by examiner

*Primary Examiner* — Stephen P Avila
(74) *Attorney, Agent, or Firm* — Farber LLC; Jonathan Winter

(57) ABSTRACT

A fin stabilizer is provided for a vessel and includes a fin which is supported by a shaft that extends below the waterline. The shaft is fixed in rotation along its elongate axis relative to the vessel and the fin includes an actuator mechanism which causes the fin to rotate around the shaft to counteract roll of the vessel. In some cases, the actuator may be hydraulic and the shaft may include passages therethrough to transfer hydraulic fluid/pressure from the vessel's interior hydraulic system through the shaft and into the actuator to cause the fin to rotate. The fin may also be able to pivot into a storage position where, for example, the shaft is folded into a cavity in the vessel hull.

18 Claims, 11 Drawing Sheets

FIN STABILIZER WITH INTERNAL ACTUATION MECHANISM

FIELD OF THE INVENTION

The invention relates to stabilizers and control systems for stabilizers that are used for marine vessels both when making headway and at rest (e.g. at anchor, or zero speed).

BACKGROUND OF THE INVENTION

External effectors for vessels come in a variety of designs. Some effectors include fin roll stabilizers which are commonly mounted to the hull of a vessel below the waterline, usually within the middle one third of the vessel's waterline length and close to the turn of the bilge. These fins typically rotate about an axis that is perpendicular to the lengthwise axis of the vessel. The stabilizer fins are generally aligned parallel to the lengthwise axis of the vessel and rotation of these fins reduces roll of the vessel. The fin roll stabilizers act in some ways that are similar to ailerons on an airplane. When the vessel is at rest (e.g. at anchor), the fins can operate through larger angle ranges to generate paddle force to reduce roll at anchor. Underway, the relative movement of water means smaller angle changes are needed since lift can be generated based on the movement of the water over the fin. Other external effectors such as trim tabs, t-foils, canards and others are known to those of skill in the art.

Most traditional fin roll stabilizers for marine vessels are driven by an in-board mechanism, utilizing hydraulic and/or electric power. This mechanism typically rotates the fin via a rotatable shaft that is fixed to the fin. The rotating shaft that penetrates the hull requires a flexible sealing method to prevent seawater from entering the vessel from around the rotating shaft. Flexible seals are subject to wear, requiring periodic replacement and a failure will compromise the watertight integrity of the hull.

The typical mechanisms used to rotate the fin are located inside the vessel and are mounted to the interior of the hull. They are typically comprised of hydraulic cylinders or electric motors and gearboxes with various sensors, and an arrangement of bearings for the rotating shaft all housed in a rigid structure substantial enough to impart the forces necessary for fin stabilization. These mechanisms can be large and occupy valuable space inside a marine vessel. In addition, placing the moving mechanisms of fin stabilizers within the vessel causes noise due to the high torques generated.

SUMMARY OF THE INVENTION

Therefore, it is an object of the invention to provide a stabilizer that houses the stabilizing mechanism inside the external effector, thus eliminating the need for a mechanism mounted in the vessel interior.

It is a further object of the invention to provide a fixed connector point on the hull exterior to which the stabilizing external effector will attach and rotate about, for example a fixed shaft which might be of e.g. a cylindrical shape. This eliminates the need for a rotating shaft through the hull and the associated seawater seals.

Another object of the invention is to provide a hydraulic actuator for the external effector which is positioned outside the vessel hull, thus avoiding the need for a rotating seal at the vessel hull. In some embodiments there is a potential further benefit to reducing use of high power electrical equipment (e.g. motors) outside the vessel hull which could become wet and cause an electrical short. However, it is contemplated that lower power electrical sensors may be used in many cases.

A further object is to reduce noise by placing components of the external effector mechanism outside the vessel where noise can be dissipated and be less perceptible to those on the vessel.

These and other objects are achieved by providing a vessel stabilization system including a fixed connector such as a fixed shaft and rotatable external effector mounted thereto, the external effector is located outside of the vessel hull below the waterline. The external effector's axis of rotation is provided by a bearing and/or bushing support structure inside the external effector. The fixed connector on the exterior of the hull will attach to an element of the bearing support structure on the external effector. Electrical wires and hydraulic hoses can be routed through the connector/shaft and into the external effector. One or more internal hydraulic motors rotate the bearing structure about the fixed connector/shaft. The motor may be attached directly to an element of the bearing/bushing structure, or by gearing or other kinematic mechanisms. The system may also include reduction gearing between the motor and the bearing structure. The bearing structure, as well as the motor and all other drive elements will be housed within a watertight structure that is fitted inside the external effector. Although the connector may be fixed, the connector does not necessarily have to be immovable. For example, the one embodiment may include shaft may fold out of the way and rotate in e.g. 90 degrees into a stored position. However, the shaft may be fixed in rotating about its elongated axis such that the rotation mechanism is embedded/part of the external effector. In some cases, no motor is provided within the external effector, rather an actuator is provided and the shaft includes passageways for hydraulic fluid to flow to thereby manipulate the actuator and external effector.

In one aspect a vessel external effector includes a external effector having a cavity therein. A hydraulic actuator is mounted inside the cavity and a connector is provided. The shaft is fixed in rotation about its elongate axis. The connector is configured to extend from the vessel below a waterline and the hydraulic actuator coupled to the connector such that the actuator, when actuated, causes the external effector to rotate about the an axis transverse to an elongated axis of the vessel while the connector remains fixed in rotation about the axis relative to the vessel.

In some aspects the hydraulic actuator includes a vane and a cavity configured to receive hydraulic fluid or have hydraulic fluid expelled in order to cause the vane displace within the cavity to change a position of the vane within the cavity. In other aspects, movement of the vane causes the external effector to rotate about the elongate axis of the shaft. In still other aspects, a bearing is mounted to the shaft outside the vessel's hull, the bearing allowing the external effector to rotate about the shaft. In other aspects a passage through the shaft is provided and hydraulic fluid is configured to pass through the passage in order to actuate the actuator to thereby cause the external effector to rotate about the elongate axis. On other aspects, hydraulic fluid extends through the passage from within the vessel's hull to outside the vessel's hull. In still other aspects, the hydraulic fluid outside the vessel's hull is contained within the actuator inside the external effector and/or shaft. In still other aspects, the actuator is controlled through an elongated passage in the shaft in order to cause the external effector to rotate about the elongate axis. In yet other aspects, the shaft includes gear teeth and the hydraulic actuator includes a gear which meshes with said gear teeth such that actuation of the hydraulic actuator causes the gear to rotate which causes the hydraulic actuator and external effector to rotate about the shaft. In other aspects the cavity includes a hydraulic pump therein.

In other aspects A vessel external effector stabilizer includes a external effector and a hydraulic actuator mounted to the external effector. A shaft is fixed in rotation along its elongate axis, and is configured to extend from the vessel below a waterline and the hydraulic actuator coupled to the external effector such that the hydraulic actuator, when actuated, causes the external effector to rotate about the elongate axis of the shaft while the shaft remains fixed in rotation about the elongate axis. In certain aspects, the shaft is sealed to the vessel with a fixed and non-rotatable seal. In other aspects a passage through the shaft is configured to allow hydraulic fluid to pass from within the vessel's hull to outside the vessel's hull. In other aspects the hydraulic actuator is controlled through an elongated passage in the shaft in order to cause the external effector to rotate about the elongate axis. In other aspects, the external effector includes a cavity which is non-symmetrical about an axis of the cavity parallel to the longitudinal axis and the hydraulic actuator is contained within a housing which fits in the cavity such that the housing and the cavity cause dimensional interference such that the external effector and cavity rotate together. In still other aspects, the shaft includes gear teeth and the hydraulic actuator includes a gear which meshes with said gear teeth such that actuation of the hydraulic actuator causes the gear to rotate which causes the actuator and external effector to rotate about the shaft. In still other aspects a pivot defines a pivot axis transverse to the longitudinal axis and wherein the shaft is configure to pivot about the pivot axis.

In yet other aspects a vessel fin stabilizer includes a fin having a hydraulic actuator and is configured to connect to a shaft which is fixed in rotation about its axis such that the hydraulic actuator is configured to generate a torque to cause the fin to rotate around the shaft and the fin configured to extend below a waterline of the vessel. In certain aspects the hydraulic actuator is configured to be pressurized with hydraulic fluid via a passageway through the shaft in order to cause the fin to rotate around the shaft. In other aspects the hydraulic actuator includes a vane within a curved cavity such that displacement of the vane due to hydraulic pressure causes the fin to rotate about the axis.

Other objects of the invention and its particular features and advantages will become more apparent from consideration of the following drawings.

DETAILED DESCRIPTION OF THE INVENTION

Figure 1:
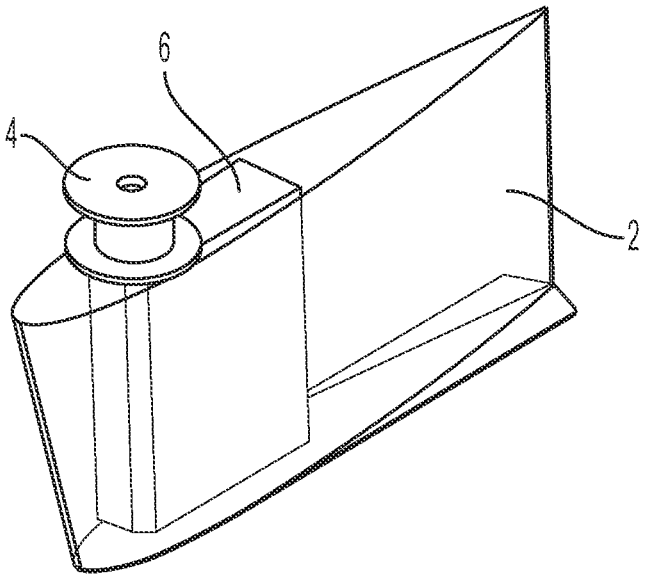
FIGS. 1-2 are a perspective view of a fin stabilizer according to an embodiment of the present invention. The hull-mounted fixed hinge point is shown attached to the top of the fin.
Figure 2:
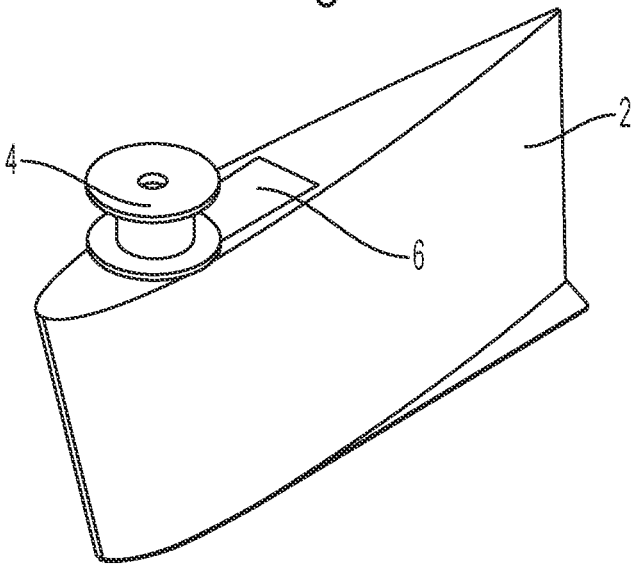

Referring now to the drawings, wherein like reference numerals designate corresponding structure throughout the views. The following examples are presented to further illustrate and explain the present invention and should not be taken as limiting in any regard.

Figure 3:
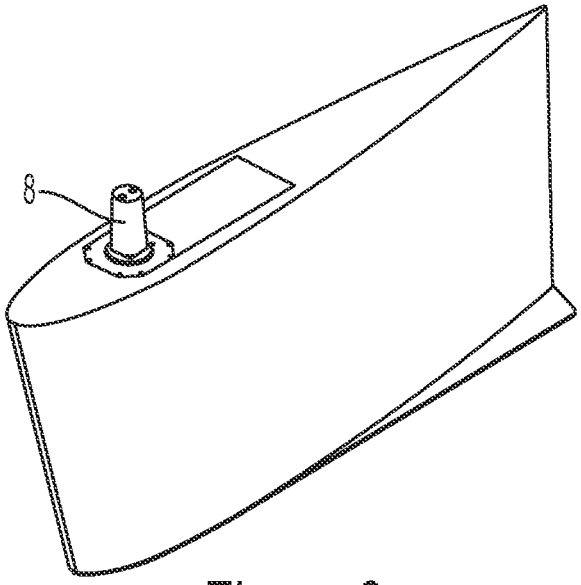
FIG. 3 is a perspective view of FIG. 1 without the hull-mounted hinge.
Figure 4A:
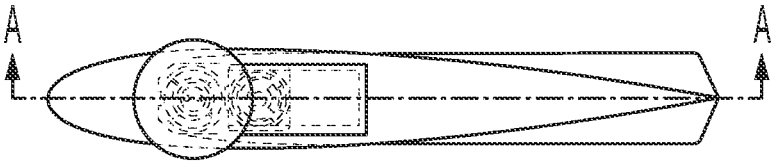
FIG. 4A is a top view of FIG. 1
Figure 4B:
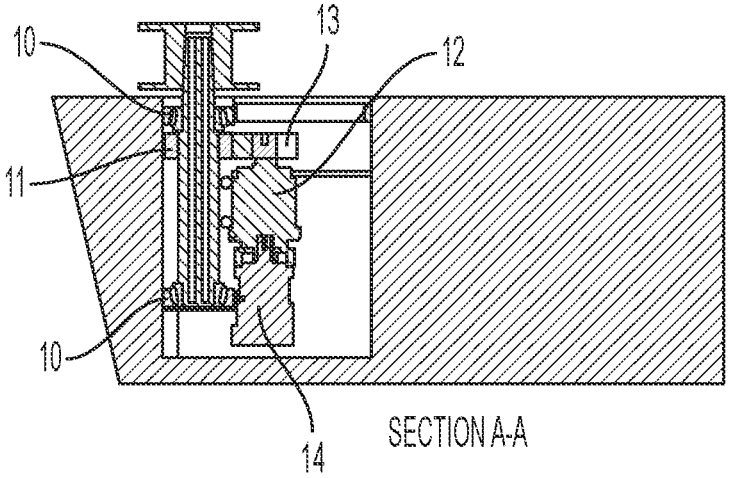
FIG. 4B is a section view along line A-A in FIG. 4A/
Figure 5:
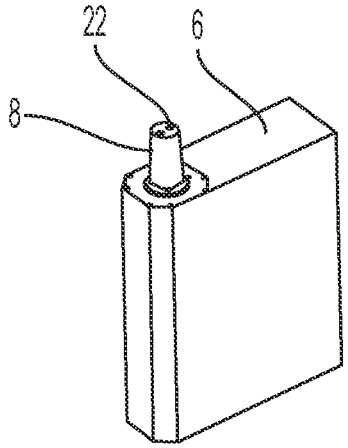
FIG. 5 is a perspective view of the internal fin drive unit of FIG. 1.
Figure 6:
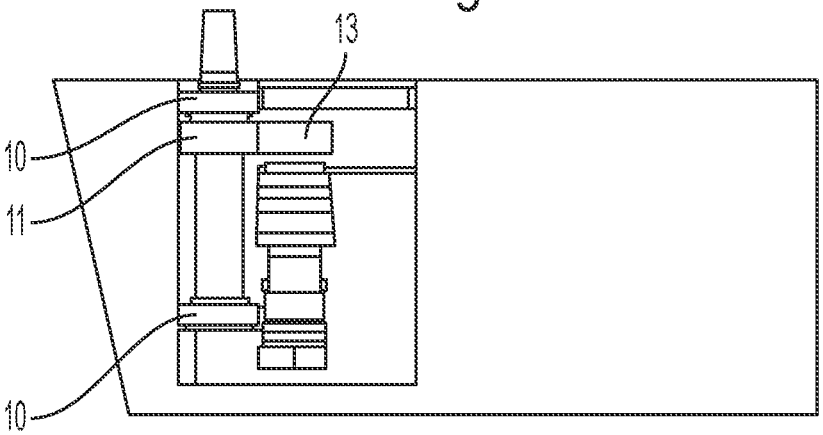
FIG. 6 is a side view cut away of the fin of FIG. 1 showing the internal fin drive unit.
Figure 7:
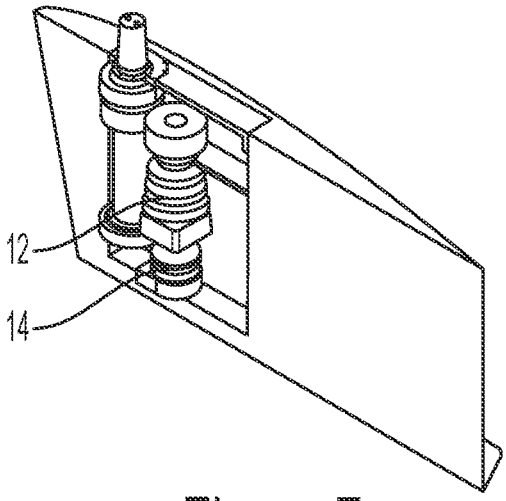
FIG. 7 is a perspective view cut away of the fin of FIG. 1 showing the internal fin drive unit.
Figure 8:
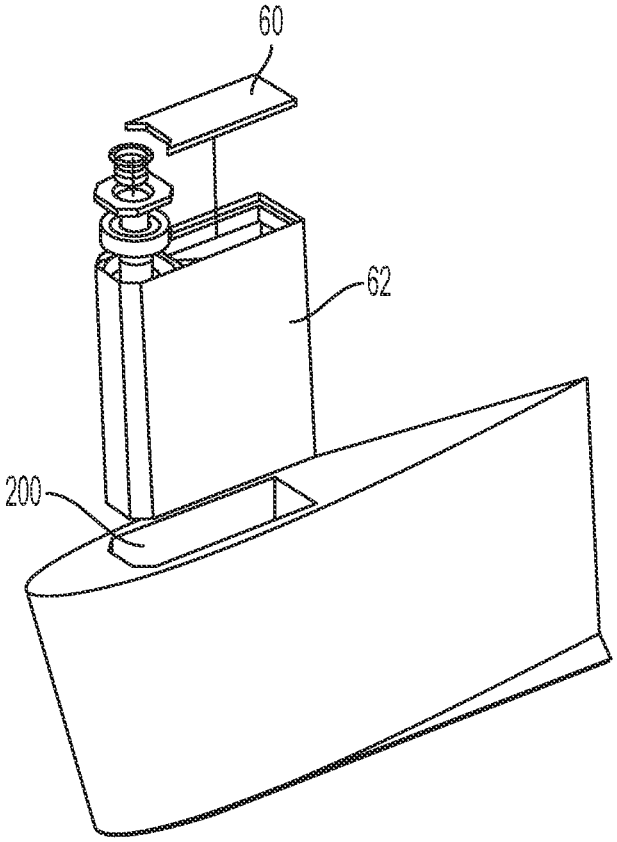
FIG. 8 is a perspective exploded view the fin of FIG. 1.

The fixed hinge mount 4 is provided for the fixed connector which may be e.g. a shaft which does not rotate. This shaft as shown extends out of the vessel below the waterline. Much like in the position shown in FIG. 6 of U.S. Pat. No. 9,944,363 (the contents of which are incorporated by reference herein). A key difference is that the external effector 2 and its mechanism housing 6 connect to the fixed shaft 8 and thus the features which cause rotation of the external effector are located in the external effector itself rather than located in the vessel hull. The mechanism housing 6 acts as a bearing support to allow rotation of the external effector 2 in that the mechanism housing 6 is mounted inside a cavity of the external effector 2 and thus when the mechanism housing 6 rotates about the fixed shaft/hinge 8, the external effector 2 will also rotate. The actuator can include bearings 10, bushings or combinations of the same mounted inside the external effector which allow the external effector to rotate about the fixed shaft 8. As shown in e.g. FIG. 3, the bearings 10 mount inside the mechanism housing 6. A motor 14 and pump 12 provide for hydraulic pressure to actuate and thus rotate the external effector around the shaft 8. The motor and pump and the hydraulic actuator in this embodiment are all mounted inside the external effector 2, more particularly inside the mechanism housing 6. The motor 14 may be an electric motor that rotates gear 13 (either directly or through a hydraulic pump) to thereby mesh with gear 11 that is fixed to the shaft. The motor 14 may be fed power through holes 22 that allow electric cables to pass through the vessel hull and into the housing 6.

As shown the housing 6 is rectangular in shape and includes removable cover 60 and main housing 62 which allows for maintenance to be performed. The housing 6 sits in cavity 200 of the external effector and dimensional interference (e.g. due to the rectangular shape) causes the housing and external effector to rotate together, thus transferring the torque generated by the motor/pump/gear to the shaft.

Figure 9:
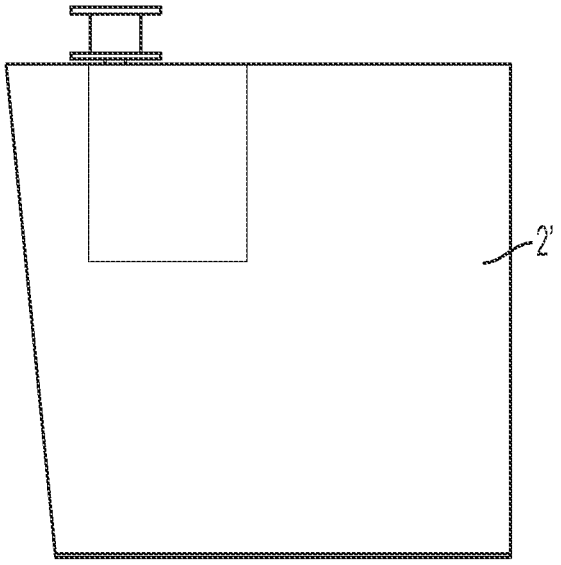
FIG. 9 shows a side view of a fin similar to FIG. 1 but with a higher aspect ratio and different actuator mechanism.
Figure 10:
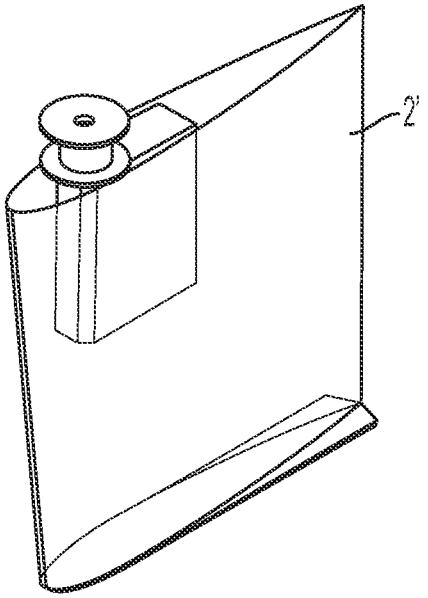
FIGS. 10-11 shows a perspective view of FIG. 9.
Figure 11:
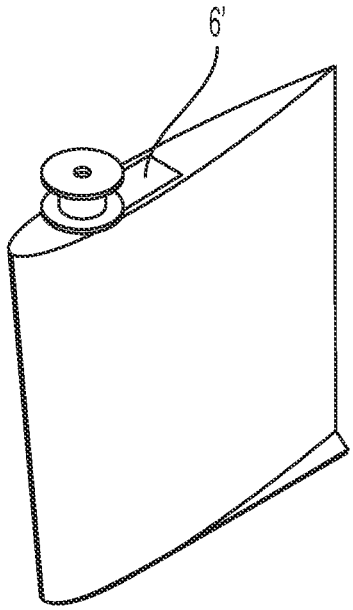
Figure 12:
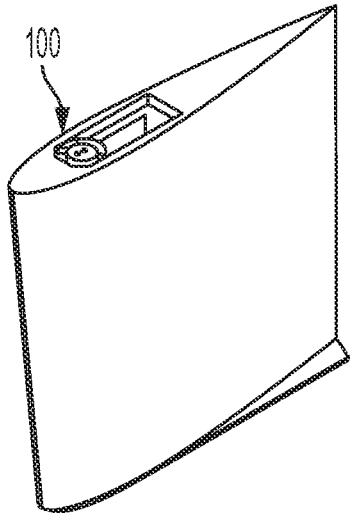
FIG. 12 shows a perspective view of FIG. 9 with some parts removed to show one actuation mechanism.
Figure 13:
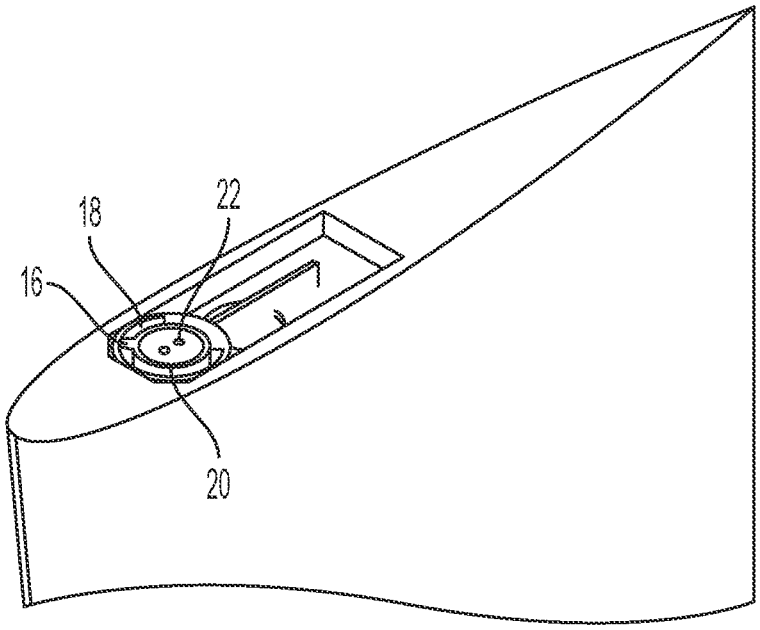
FIGS. 13-14 show perspective detail views of FIG. 12.
Figure 14:
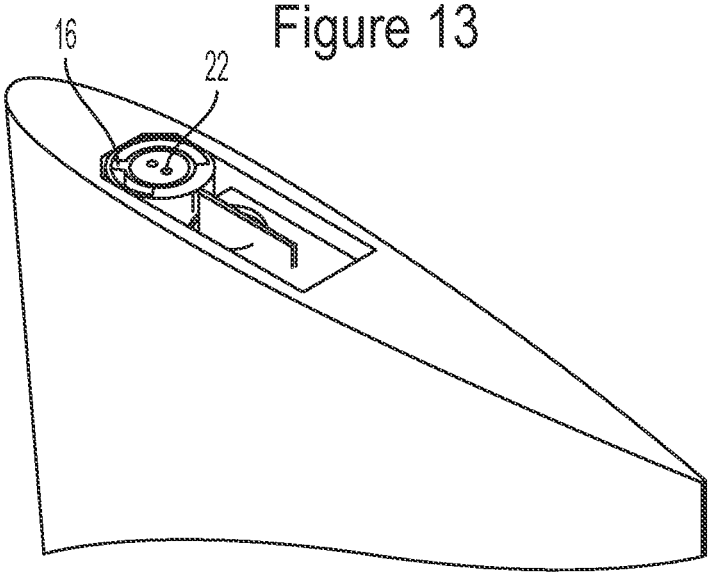

An alternative external effector/actuator design shown in FIG. 9 can also be provided. The embodiment shown has a larger aspect ratio for the external effector (which could be employed with other actuators contemplated herein). However, the actuator mechanism in FIG. 9 as shown in the related figures includes a rotary vane actuator. See e.g. in FIG. 15. Here, vane 16 is moved by fluid in cavity sections 20/18. The hydraulic system can add fluid to cavity section 20, thus causing vane 16 to displace in rotation into cavity section 18. The cavity sections 18/20 are really one cavity but separated by vane 16 which causes the cavity sections 18/20 to change in size as different amounts of hydraulic fluid are introduced/removed in the sections. This actuator can thus have a minimal amount of hydraulic fluid and the process of adding/removing fluid from one side of the vane will cause the external effector 2 to rotate about the fixed shaft 8.

Holes 22 can be provided to feed hydraulic fluid into the external effector from inside the hull. Signaling/sensor cables may also route through these holes 22. In one embodiment, the motor/pump can be located inside the hull with the actuator inside the external effector and the holes 22 can be used to feed hydraulic fluid either through routing lines or through the holes 22 providing a passageway for hydraulic fluid. In all scenarios, the shaft/hinge 8 remains fixed in rotation along its elongated axis and the external effector rotates around this fixed shaft 8. Other types of hydraulic actuators and electric actuators known to those of skill in the art may be used and mounted inside the external effector. Although it may be one preferred embodiment to avoid use of electrical equipment outside the vessel's hull, it is contemplated that in certain scenarios, electrical equipment may be the preferred embodiment, for example motors, sensors etc.

Therefore, in the embodiment of FIG. 9 and related figures, the actuator's motor is positioned within the vessel hull. This motor may be for the larger hydraulic system of the vessel or may be a dedicated motor/pump. However, since the shaft is provided with holes 22, the hydraulic pressure generated from within the vessel can be used to cause the external effector to rotate.

The holes 22 may provide signaling and power supply to electric motors which are positioned in the external effector and configured to cause the external effector to rotate about the shaft as shown in FIG. 1 and the related figures and the motor may be direct drive or provided with e.g. a reduction gearing. However, in a number of possible hydraulic actuator embodiments such as the one in FIG. 9 and related figures, these holes 22 may effectively operate as pipes/plumbing for the hydraulic system thus allowing fluid to pass from within the vessel hull to outside the vessel hull. Although the holes 22 are shown as two off center holes in certain embodiments, a centrally located hole may also contain hydraulic lines. In some hydraulic actuation embodiments, two holes are required as one is the feed pipe and the other is the return pipe, depending on how the actuator/valve is being operated. For example, one hole may be connected to cavity section 18 and the other to section 20. This avoids use of valves within the actuator and simplifies the design outside the vessel hull. Thus, if a valve/controller is used to pressurize one line and allow fluid to flow back from the other, this valve can be positioned inside the vessel's hull. One benefit of such an arrangement is that the valve can be subject to frequent cycling and wear and thus require replacement over time. Thus, with the valve/controller within the vessel's hull, there is easier access that does not require dry docking or removal of the external effector by a diver/swimmer, but the valve is a relatively small component that may be part of a larger manifold/controller. It is understood that with the rotatory vane actuator, if one hole is pressurized to feed fluid out of the vessel, the vane in displacing will thereby feed fluid from the other hole back into the vessel, thus forming a loop. Reversing the flow direction will cause the external effector to rotate in the opposite direction.

Figure 15:
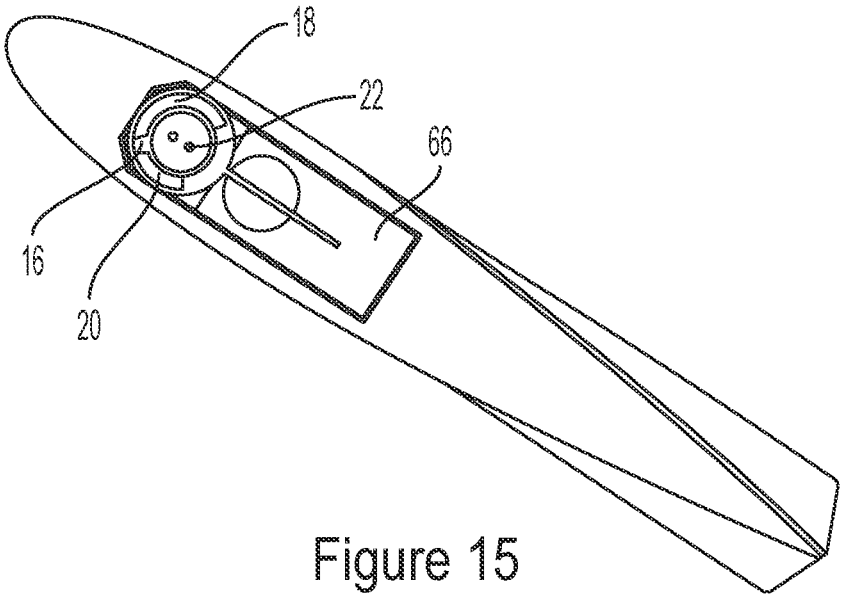
FIGS. 15-16 are top views of FIG. 12 with the fin in different rotational positions.
Figure 16:
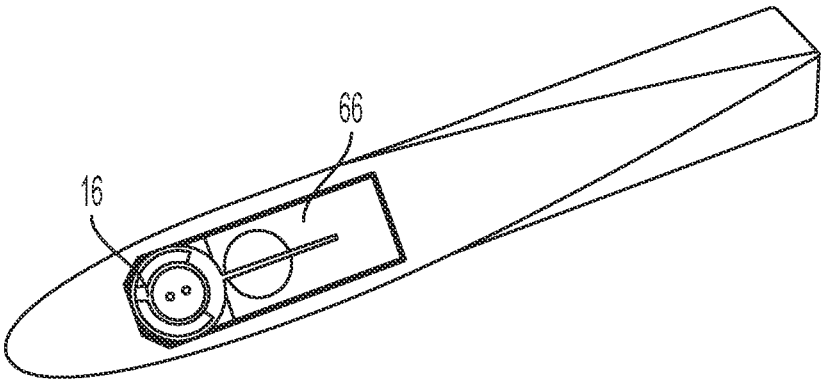
Figure 17:
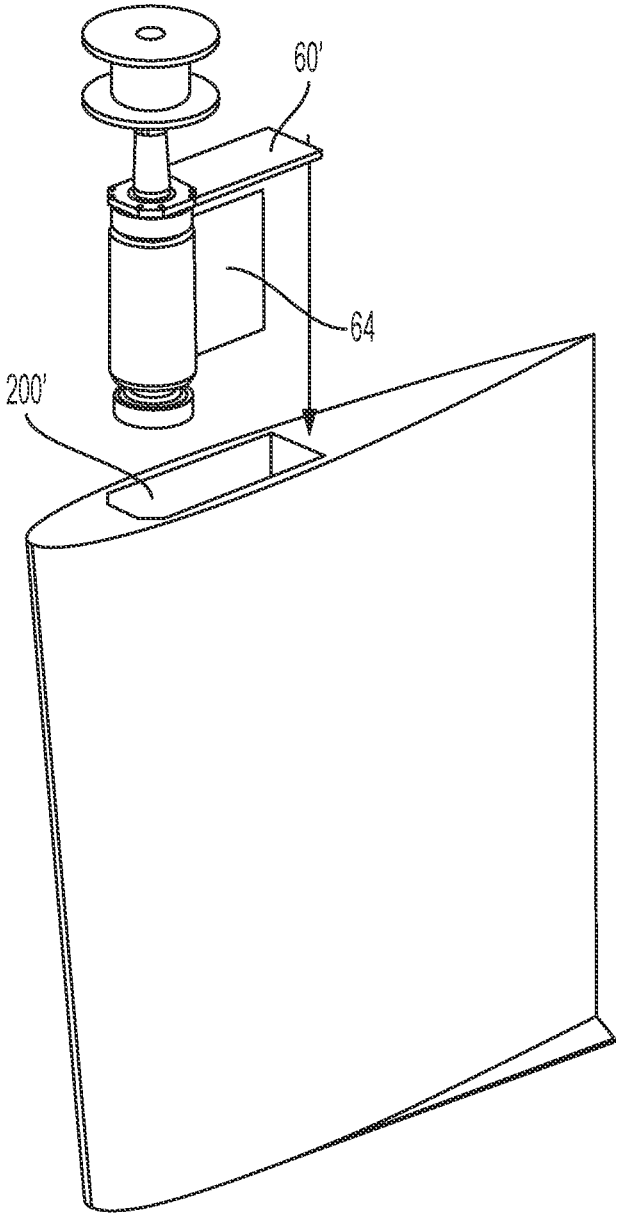
FIG. 17 shows an exploded view of the fin and actuator of FIG. 9.
Figure 18:
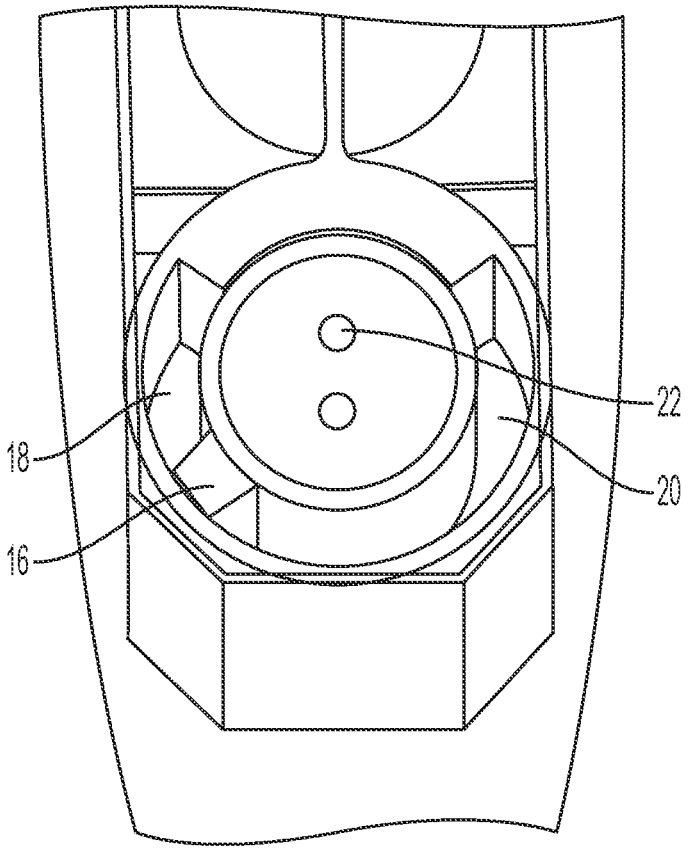
FIG. 18 shows a detailed view of the actuator mechanism of the fin in FIG. 9.

Referring to FIGS. 15-17, an arm 64 is provided on the actuator and a block 66 with a slot is positioned in the cavity 200'. The arm 64 fits in the slot which allows the actuator to transfer the torque generated to the external effector to cause the external effector to rotate.

Figure 19:
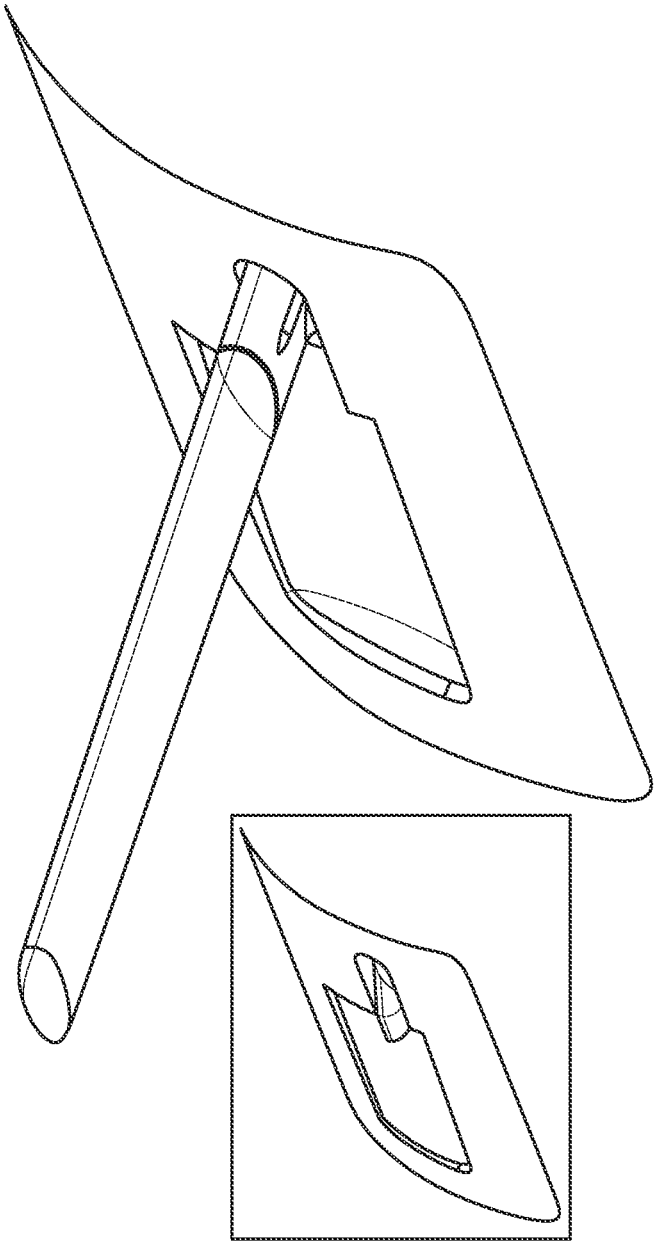
FIG. 19 shows a fin actuator which could be made according to any of the previous figures but with an added retractable/pivotable embodiment.

FIG. 19 shows another example where the shaft/hinge remains fixed in rotation such that the external effector rotates around or relative to the shaft/hinge, however in the embodiment shown, the shaft/hinge includes a pivot which allows the external effector to pivot e.g. into a storage position generally aligned with the hull or preferably within a cavity in the hull. Another alternative is that the pivot allows fore/aft movement of the external effector to generate relative flow of water over the effector when the vessel is at rest, then the external effector is rotated to vary the angle of attack and thus lift generated. Referring back to FIG. 19, as can be seen, in the open position, the external effector and mechanism looks largely similar if not identical to previously described external effectors herein with regards to the rotation mechanism within the external effector itself however it is sometimes desirable to retract the stabilizer external effector and thus the internal external effector mechanism would rotate the external effector to an approximately 90 deg position relative to neutral (no angle of attack) and then the pivot would cause the external effector to pivot into this storage position. Thus, the shaft/hinge is fixed in rotation from the view of the angle of attack of the external effector and the external effector itself will rotate around that shaft/hinge to change the external effector/foil angle of attack. However, this fixed shaft/hinge may still pivot for storage. The pivoting feature can be added to any of the embodiments herein and as stated, the pivoting may be for storage and/or for generating relative flow when the vessel is at rest.

As shown herein, various motor/movement device configurations involve the external effector having a cavity of some kind which prevents relative rotation of the motor and housing due to dimensional interference. This causes the motor and external effector element which surrounds the motor to rotate together about the shaft.

The fin as used and described herein is of a symmetrical foil shape, but it is contemplated that other shapes may be employed for the fin. Further, a foil shape which is non symmetrical may be used as the fin in that the upper shape/camber may differ from the lower. Other examples of fins may include T foils, bow foils and related trim tabs and other control surfaces that generate lift or manipulate lift generating devices. The fin may comprise any acceptable lift generating device which can generate lift and/or paddle force by rotating. It is further understood that the shaft does not necessarily need to be round as shown in the preferred embodiment. For example, a square or oval cross section are two examples of different shapes that could be employed. The connector as described herein includes but is not limited to the elongated shaft shown and described herein.

Although the invention has been described with reference to a particular arrangement of parts, features and the like, these are not intended to exhaust all possible arrangements or features, and indeed many other modifications and variations will be ascertainable to those of skill in the art and it is understood that each of the features described herein may or may not be included in particular embodiments contemplated by this disclosure.

What is claimed is:

1. A vessel stabilizer comprising:

a fin having a cavity therein;

a hydraulic actuator mounted inside said cavity;

a shaft which is fixed in rotation about its elongate axis, the shaft configured to extend from the vessel below a waterline and the hydraulic actuator coupled to the shaft such that the actuator, when actuated, causes the fin to rotate about the elongate axis of the shaft while the shaft remains fixed in rotation about the elongate axis relative to the vessel.

2. The device of claim 1 wherein the hydraulic actuator includes a vane and a cavity configured to receive hydraulic fluid.

3. The device of claim 2 wherein movement of the vane causes the fin to rotate about the elongate axis of the shaft.

4. The device of claim 1 further comprising one or more bearings or bushings or combinations thereof mounted to the shaft outside a hull of the vessel and allowing the fin to rotate about the shaft.

5. The device of claim 1 further comprising a passage through the shaft through which hydraulic fluid is configured to pass in order to actuate the actuator to thereby cause the fin to rotate about the elongate axis.

6. The device of claim 5 wherein the hydraulic fluid extends through the passage from within the vessel's hull to outside the vessel's hull.

7. The device of claim 6 wherein the hydraulic fluid outside the vessel's hull is contained within the actuator inside the fin and/or shaft.

8. The device of claim 1 wherein the actuator is controlled through an elongated passage in the shaft in order to cause the fin to rotate about the elongate axis.

9. The device of claim 1 wherein the shaft includes gear teeth and the hydraulic actuator includes a gear which meshes with said gear teeth such that actuation of the hydraulic actuator causes the gear to rotate which causes the hydraulic actuator and fin to rotate about the shaft.

10. The device of claim 1 wherein the cavity includes a hydraulic pump therein.

11. A vessel stabilizer comprising:

a fin;

a hydraulic actuator mounted to said fin;

a connector which is fixed in rotation relative to the vessel and positioned below a waterline of the vessel and the hydraulic actuator coupled to the fin such that the hydraulic actuator, when actuated, causes the fin to rotate about an axis transverse to an elongated axis off the vessel defined from bow to stern while the connector remains fixed in rotation about the axis; and a passage through the connector configured to allow hydraulic fluid to pass from within the vessel's hull to outside the vessel's hull.

12. The vessel of claim 11 wherein the connector is elongated and is sealed to the vessel with a fixed and non-rotatable seal.

13. The device of claim 11 wherein the hydraulic actuator is controlled through an elongated passage in the connector in order to cause the fin to rotate about the axis.

14. The device of claim 11 wherein the fin includes a cavity which is non-symmetrical about an axis of the cavity parallel to the longitudinal axis and the hydraulic actuator is contained within a housing which fits in the cavity such that the housing and the cavity cause dimensional interference such that the fin and cavity rotate together and wherein the connector extends into the housing to connect to the actuator.

15. The device of claim11 wherein the connector is a shaft which includes gear teeth and the hydraulic actuator includes a gear which meshes with said gear teeth such that actuation of the hydraulic actuator causes the gear to rotate which causes the actuator and fin to rotate about the shaft.

16. The device of claim 11 further comprising a pivot which defines a pivot axis transverse to the axis and wherein the shaft is configured to pivot about the pivot axis.

17. A vessel stabilizer comprising:

a fin having a hydraulic actuator and is configured to connect to a connector which is fixed in rotation relative to the vessel and below a waterline of the vessel, wherein the hydraulic actuator is configured to generate a torque to cause the fin to rotate around the connector about an axis and wherein the connector connects to the actuator within the fin; and wherein the hydraulic actuator is configured to be pressurized with hydraulic fluid via a passageway through the connector in order to cause the fin to rotate around the shaft.

18. The device of claim 17 wherein the hydraulic actuator includes a vane within a curved cavity such that displacement of the vane due to hydraulic pressure causes the fin to rotate about the axis.

* * * * *